US007734210B2

(12) United States Patent
Nishida

(10) Patent No.: US 7,734,210 B2
(45) Date of Patent: Jun. 8, 2010

(54) PRINTING SYSTEM, PRINTING METHOD AND PRINTER DRIVER

(75) Inventor: Masanori Nishida, Kobe (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 356 days.

(21) Appl. No.: 11/987,876

(22) Filed: Dec. 5, 2007

(65) Prior Publication Data

US 2008/0175616 A1 Jul. 24, 2008

(30) Foreign Application Priority Data

Jan. 24, 2007 (JP) ..... 2007-013252

(51) Int. Cl.
*G03G 15/00* (2006.01)

(52) U.S. Cl. ..... 399/81; 399/8

(58) Field of Classification Search ..... 399/8, 399/9, 16, 23, 38, 75, 81; 358/1.13, 1.14, 358/1.15

See application file for complete search history.

(56) References Cited

U.S. PATENT DOCUMENTS

| | | | | |
|---|---|---|---|---|
| 6,493,099 | B2 * | 12/2002 | Nakagiri | 358/1.13 |
| 6,717,693 | B2 * | 4/2004 | Mitsuhashi et al. | 358/1.15 |
| 6,977,739 | B2 * | 12/2005 | Higuchi et al. | 358/1.15 |
| 7,108,435 | B2 * | 9/2006 | Hayashi | 400/76 |
| 7,518,744 | B2 * | 4/2009 | Komagamine et al. | 358/1.15 |

FOREIGN PATENT DOCUMENTS

| | | |
|---|---|---|
| JP | 03-268978 | 11/1991 |
| JP | 2000-108460 | 4/2000 |
| JP | 2001-180081 | 7/2001 |
| JP | 2001-318778 | 11/2001 |
| JP | 2006-254042 A | 9/2006 |

OTHER PUBLICATIONS

Office Action issued in corresponding Japanese Application No. 2007-013252 dated Nov. 19, 2008, and an English Translation thereof.

* cited by examiner

*Primary Examiner*—Hoan Tran
(74) *Attorney, Agent, or Firm*—Buchanan Ingersoll & Rooney PC

(57) ABSTRACT

There is described a printing system in which a computer terminal device and an image forming apparatus are coupled to each other through a communication network. The computer terminal device includes: an apparatus information acquiring section to acquire apparatus information that includes information in regard to a kind of paper-sheet feeding tray of the image forming apparatus and a kind of paper sheet corresponding to the paper-sheet feeding tray, from the image forming apparatus; a display section to display a specific screen for setting a print condition; and a print condition setting section to control the display section, so that both the apparatus information and setting information that includes information in regard to a kind of paper-sheet feeding tray and a kind of paper sheet corresponding to the paper-sheet feeding tray, which are established in advance by a user or as default information, are displayed on the specific screen.

6 Claims, 9 Drawing Sheets

PRINTING SYSTEM, PRINTING METHOD AND PRINTER DRIVER

CROSS-REFERENCE TO RELATED APPLICATION

This application is based on Japanese Patent Application No. 2007-013252 filed on Jan. 24, 2007 with Japan Patent Office, the entire content of which is hereby incorporated by reference.

BACKGROUND OF THE INVENTION

1. Field of the Invention

The present invention relates to a printing system, a printing method and a printer driver.

2. Description of Related Art

In recent years, there have been increasingly proliferated in the market various kinds of copiers or multi-functional apparatuses, each provided with a combination of plural functions, such as a copy function, a facsimile function, a printer function, a scanner function, etc., (hereinafter, referred to as an image forming apparatus as a general term for each of them). When the image forming apparatus is employed as the network printer to implement the printing operation, at first, the concerned document is created by using the application program installed in advance in the computer terminal device coupled to the network, and then, the created document is converted to the print data in the format of the Page Description Language (hereinafter, also referred to as the PDL, for simplicity) by employing software (printer driver) for controlling the image forming apparatus, so as to be transmitted to the image forming apparatus concerned. Receiving the print data from the computer terminal device, the image forming apparatus parses the print data to create intermediate data, and then, further converts the intermediate data to bitmap data, so as to output an image based on the bitmap data onto a paper medium. For instance, the abovementioned image forming apparatus is set forth in Tokkai 2006-254042 (Japanese Non-Examined Patent Publication)

In this connection, when the user instructs the computer terminal device to implement the printing operation from a document application program currently installed in the computer terminal device, a print setting screen for selecting an image forming apparatus implementing the printing operation and for setting pages to be printed, a number of copies, etc., is displayed on the computer terminal device concerned. However, in a typical situation, it is impossible for the user to select a kind of paper sheet from the print setting screen above-mentioned. Accordingly, for instance, when the user wishes to use a specific paper sheet, such as an OHP sheet, etc., he should conduct a predetermined button operation (for instance, a depression of a property button) to display a screen for setting the printing conditions (hereinafter referred to as a document property screen), and then, conducts the setting operations of the items in regard to the kind of paper sheet, a paper sheet feeding tray, etc., as desired by the user, from the document property screen.

However, since the items in regard to a kind of paper sheet, a paper sheet feeding tray, etc., displayed on the document property screen, are user settable items, which can be arbitrarily set by the user, the setting status of such the items does not necessary match with an actual status of the image forming apparatus concerned (namely, a kind of paper sheets actually accommodated in the paper sheet feeding tray of the image forming apparatus concerned).

Accordingly, in order to prevent erroneous settings of the items in regard to a kind of paper sheet, a paper sheet feeding tray, etc., the user should take any one of the three actions, including: (1) making the computer terminal device display a screen indicating the actual status of the image forming apparatus (hereinafter, referred to as a device property screen) by using a bilateral communicating function of the printer driver, so as to confirm the actual status of the image forming apparatus; (2) confirming the actual status of the image forming apparatus on the computer terminal device by using a predetermined utility tool; and (3) going to a site in which the image forming apparatus is installed, to confirm a kind of paper sheets accommodated in each of the paper sheet feeding tray. Among the three methods mentioned in the above, since the method (2) has no versatility due to the necessity of the utility tool, while the actual implementation of method (3) is quite difficult due to the fact that the computer terminal device and the image forming apparatus are installed in separate sites being remote from each other, the method (1) is employed in general.

Referring to the flowchart shown in FIG. 9, the printing procedure in the case of using the abovementioned device property screen will be detailed in the following.

Initially, in Step S201, the user operates an operating section of the computer terminal device to display a list of image forming apparatuses, being controllable by the computer terminal device, onto a display section, so as to select an image forming apparatus desired by the user, and then, makes the display section display a device property screen 50 shown in FIG. 10. On this device property screen 50, various kinds of information in respect to the image forming apparatus are indicated while classifying them with tabs, and, by selecting a specific tab (herein, "apparatus information" tab) from the tabs indicated, various information in regard to the paper sheet accommodated in each of the paper sheet feeding tray, such as a size and a direction of the paper sheet, a kind of paper sheet, etc., are indicated within an apparatus information display column 51 (herein "paper sheet feeding tray information" column). Successively, the user observes the apparatus information display column 51 in order to confirm and memorize in which tray the paper sheet to be employed for the printing operation is accommodated. For instance, when the user wishes to employ an OHP sheet for printing, the user memorizes the fact that the OHP sheet is accommodated in tray 4.

Successively, the user develops the document application program, installed in advance in the computer terminal device, to create the document data, or, after reading out the document data stored in a storage section, such as a server, etc., and after displaying the print setting screen by instructing the printing operation from the document application program, the user conduct a predetermined button operation so as to display a document property screen 52 shown in FIG. 11 (Step S202). On this document property screen 52, various kinds of items for setting the print conditions are indicated while classifying them with tabs, and, by selecting a specific tab (herein, "setup" tab) from the tabs indicated, the items, including the document direction, the document size, the output image size, the zooming, the paper sheet feeding tray, etc., are displayed in the paper sheet column, and, in each of the items, the information set by the user or established as default information is indicated.

Still successively, in Step S203, the user compares the paper sheet feeding tray confirmed in the device property screen 50 with that established in the document property screen 52, and confirms whether or not the paper sheet feeding tray to be employed for printing is selected in the item of paper sheet feeding tray in the paper sheet column of the document property screen 52. For instance, when the user wishes to employ the OHP sheet for printing, the user confirms the fact that the tray 4 is actually selected.

Still successively, in Step S204, the user depresses a screen shift button 53 (in this case, "paper sheet kind setting" button) to display a paper-sheet kind setting screen 54, so as to confirm the kind of paper sheet accommodated in the paper sheet feeding tray, which is to be employed for printing.

Yet successively, in Step S205, the user determines whether or not the current establishment of the kind of paper sheet should be changed. When determining that the current establishment of the kind of paper sheet should be changed, the user depresses a shift button 55 (herein, "edit" button) in the paper-sheet kind setting screen 54 so as to display a paper-sheet kind editing screen 56 (Step S206), and then, the user sets the other kind of paper sheet (herein, OHP sheet) appropriate for the paper sheet feeding tray concerned (Step S207).

After that, the user sequentially closes the paper-sheet kind editing screen 56, the paper-sheet kind setting screen 54 and the document property screen 52 one by one, and returns to the print setting screen, in order to instruct the printing operation. In response to the instruction of the printing operation, the print driver converts the document data to print data, and transmits the print data to the image forming apparatus concerned, so as to make the image forming apparatus implement the printing operation by designating the paper sheet feeding tray (Step S208).

As mentioned in the above, when printing a document based on document data onto a specific kind of paper sheet, there has been necessary to confirm the actual status of the image forming apparatus from the device property screen 50 in advance, and then, to establish the items in regard to the paper sheet, such as a paper sheet feeding tray, a kind of paper sheet, etc., in advance, by using the document property screen 52, the paper-sheet kind setting screen 54 and the paper-sheet kind editing screen 56. Accordingly, there have been problems that errors in the setting items in regard to the paper sheet are liable to occur, and maneuverability during the printing operation is bad.

SUMMARY OF THE INVENTION

To overcome the abovementioned drawbacks in conventional printing systems, it is one of objects of the present invention to provide a printing system, a printing method and a printer driver, which make it possible not only to prevent errors in the setting items in regard to the paper sheet, such as a paper sheet feeding tray, a kind of paper sheet, etc., in advance, but also to improve the user's maneuverability during the printing operation.

Accordingly, to overcome the cited shortcomings, at least one of the objects of the present invention can be attained by any one of the printing systems, the printing methods and the computer readable mediums, described as follows.

(1) According to a printing system reflecting an aspect of the present invention, the printing system comprises: a computer terminal device to issue an instruction for implementing a printing operation; and an image forming apparatus that receives the instruction issued by the computer terminal device to implement the printing operation; wherein the computer terminal device and the image forming apparatus are coupled to each other through a communication network; and wherein the computer terminal device includes: an apparatus information acquiring section to acquire apparatus information that includes information in regard to a kind of paper-sheet feeding tray provided in the image forming apparatus and a kind of paper sheet corresponding to the paper-sheet feeding tray, from the image forming apparatus; a display section to display a specific screen for setting a print condition; and a print condition setting section to control the display section, so that both the apparatus information and setting information that includes information in regard to a kind of paper-sheet feeding tray and a kind of paper sheet corresponding to the paper-sheet feeding tray, which are established in advance by a user or established in advance as default information, are displayed on the specific screen.

(2) According to another aspect of the present invention, in the printing system recited in item 1, the print condition setting section controls the display section to display a specific button on the specific screen; and, when the specific button is designated, the print condition setting section corrects the setting information based on the apparatus information, so as to correlate the apparatus information and the setting information with each other.

(3) According to a printing method reflecting another aspect of the present invention, the printing method employed in a system, in which a computer terminal device to issue an instruction for implementing a printing operation, and an image forming apparatus that receives the instruction issued by the computer terminal device, to implement the printing operation, are coupled to each other through a communication network, the printing method comprises: acquiring apparatus information that includes information in regard to a kind of paper-sheet feeding tray provided in the image forming apparatus and a kind of paper sheet corresponding to the paper-sheet feeding tray, from the image forming apparatus through the communication network by the computer terminal device; and displaying a specific screen for setting a print condition on a display section provided in the computer terminal device; wherein, in the displaying step, both the apparatus information and setting information that includes information in regard to a kind of paper-sheet feeding tray and a kind of paper sheet corresponding to the paper-sheet feeding tray, which are established in advance by a user or established in advance as default information, are displayed on the specific screen.

(4) According to still another aspect of the present invention, in the printing method recited in item 3, in the displaying step, a specific button is displayed on the specific screen; and, when the specific button is designated, the setting information is corrected, based on the apparatus information, so as to correlate the apparatus information and the setting information with each other.

(5) According to a computer readable medium reflecting still another aspect of the present invention, the computer readable medium storing a computer executable program for controlling an image forming apparatus to be coupled to a computer through a communication network, the program comprises program code for causing the computer to perform the steps of: acquiring apparatus information that includes information in regard to a kind of paper-sheet feeding tray provided in the image forming apparatus and a kind of paper sheet corresponding to the paper-sheet feeding tray, from the image forming apparatus through the communication network; displaying a specific screen for setting a print condition on a display section provided in the computer; and controlling the display section, so that both the apparatus information and setting information that includes information in regard to a kind of paper-sheet feeding tray and a kind of paper sheet corresponding to the paper-sheet feeding tray, which are established in advance by a user or established in advance as default information, are displayed on the specific screen.

(6) According to still another aspect of the computer readable medium, in the computer readable medium recited in item 5, in the displaying step, a specific button is displayed on the specific screen; and, when the specific button is designated, the setting information is corrected, based on the apparatus information, so as to correlate the apparatus information and the setting information with each other.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF PREFERRED EMBODIMENTS

Figure 1:
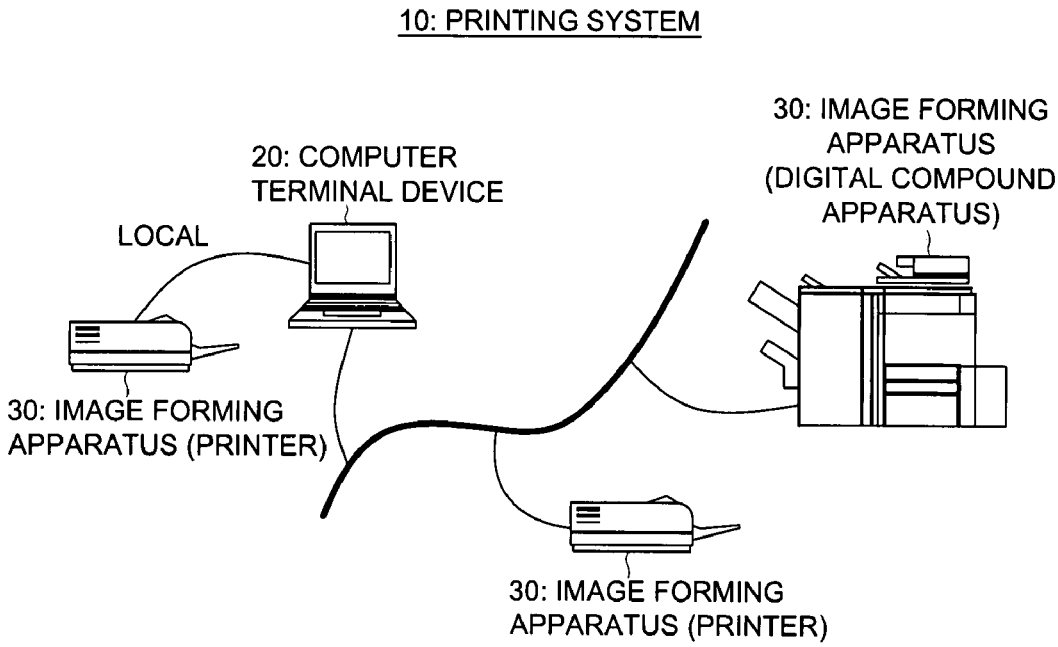
FIG. 1 shows a schematic diagram of a configuration of a printing system embodied in the present invention.

As mentioned in the "BACKGROUND OF THE INVENTION", when the user intends to print a document based on the document data, created or acquired by the computer terminal device, onto a specific kind of paper sheet, it is necessary for the user to confirm the items in regard to the paper sheet, such as a paper sheet feeding tray, a kind of paper sheet, etc., in advance, by making the computer terminal device display the paper-sheet kind editing screen on the display section, after confirming the actual status of the image forming apparatus from the device property screen displayed on the display section of the computer terminal device. Then, if the user wishes to change the setting items, it is further necessary for the user to edit the concerned items by making the computer terminal device display the paper-sheet kind editing screen on the display section. Accordingly, there have been problems that errors in the setting items are liable to occur, and the maneuverability during the printing operation is bad.

The abovementioned problems are caused by the fact that the apparatus information, indicating the actual status of the image forming apparatus in respect to the paper sheets, and the setting information, established in advance by the user or as the default information in respect to the paper sheets, are displayed on the separate screens being different from each other, and there is no method for correlating the apparatus information and the setting information with each other.

To overcome the abovementioned problems, in the preferred and exemplary embodiment of the present invention, a control section or the printer driver installed in the computer terminal device conducts such a controlling operation that makes the display section display both the apparatus information and the setting information (preferably, in parallel) on the paper sheet setting screen being shiftable by operating a predetermined button displayed on the document property screen, and further, makes the display section display a correlation button for correlating the apparatus information and the setting information with each other in the paper sheet setting screen. With the abovementioned features of the present invention, it becomes possible for the user not only to confirm and compare both the apparatus information and the setting information with each other without displaying the document property screen, but also to reflect the contents of the apparatus information onto the setting information by simply designating (for instance, depressing or selecting) the correlation button without conducting the setting information change operation to be conducted by the user himself. According to the above features of the preferred and exemplary embodiment of the present invention, it becomes possible to prevent errors in the setting items in regard to the paper sheet, such as a paper sheet feeding tray, a kind of paper sheet, etc., in advance, resulting in improvement of the maneuverability during the printing operation.

Embodiment

Figure 2:
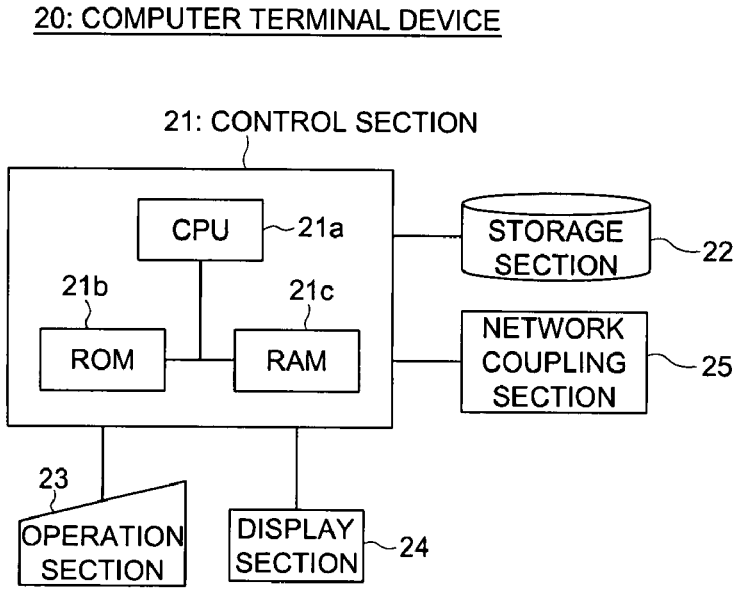
FIG. 2 shows a block diagram indicating a configuration of a computer terminal device embodied in the present invention.
Figure 3:
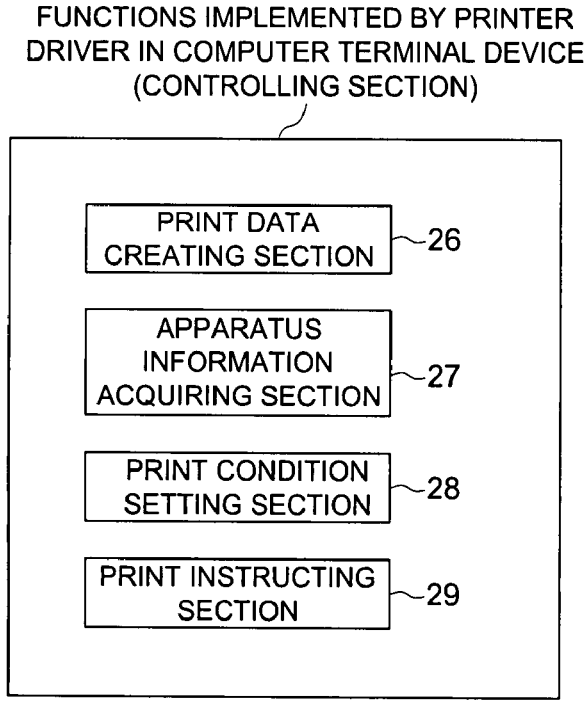
FIG. 3 shows a block diagram indicating functions of a printer driver embodied in the present invention.
Figure 4:
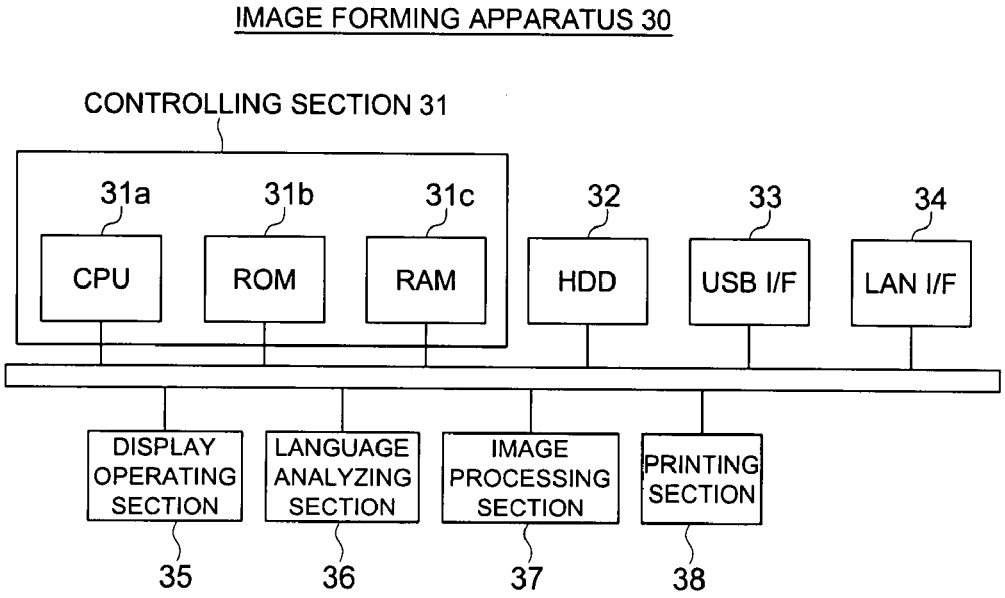
FIG. 4 shows a block diagram indicating a configuration of an image forming apparatus embodied in the present invention.
Figure 5:
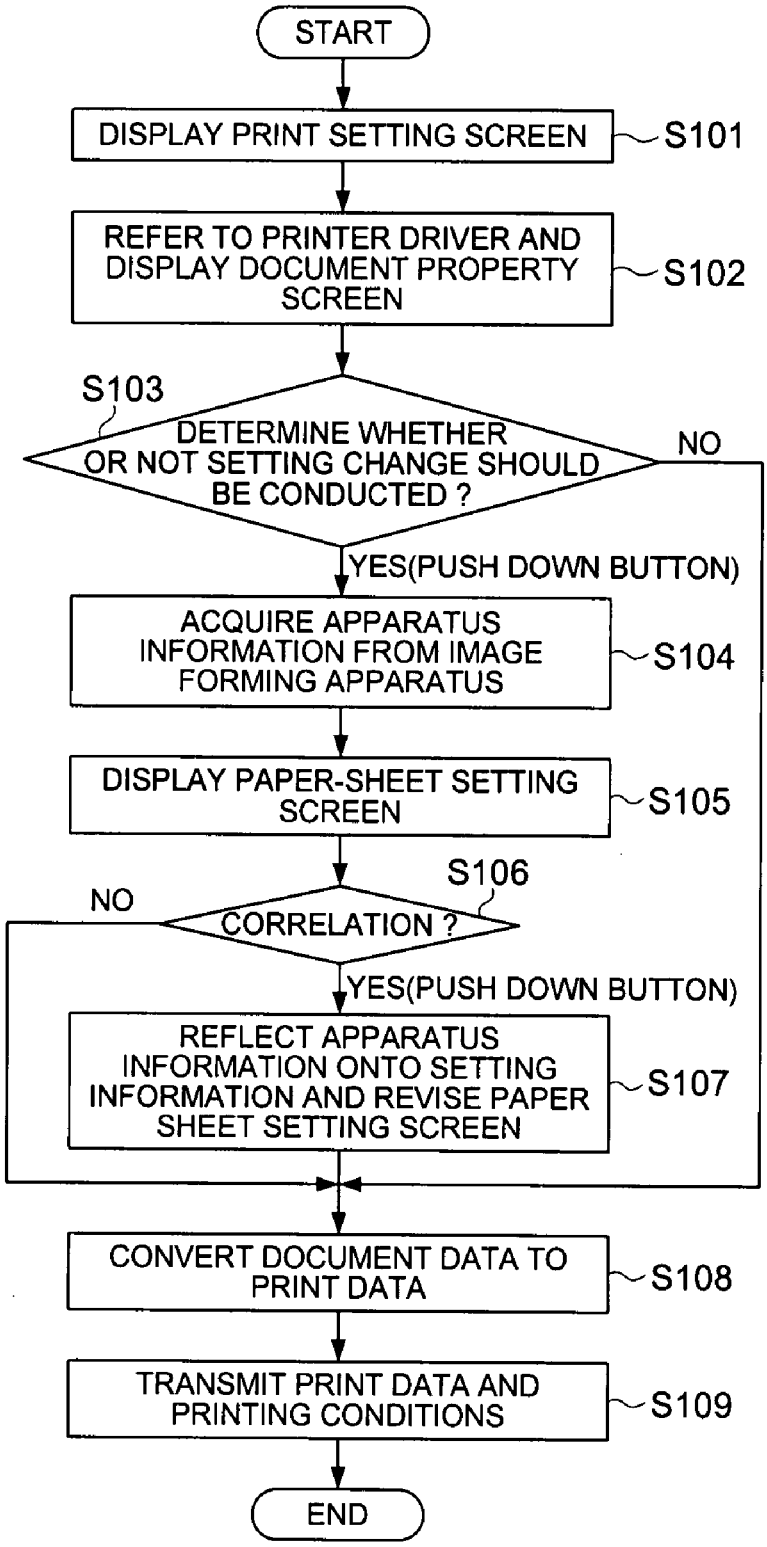
FIG. 5 shows a flowchart of printing procedures to be employed in a printing system embodied in the present invention.
Figure 6:
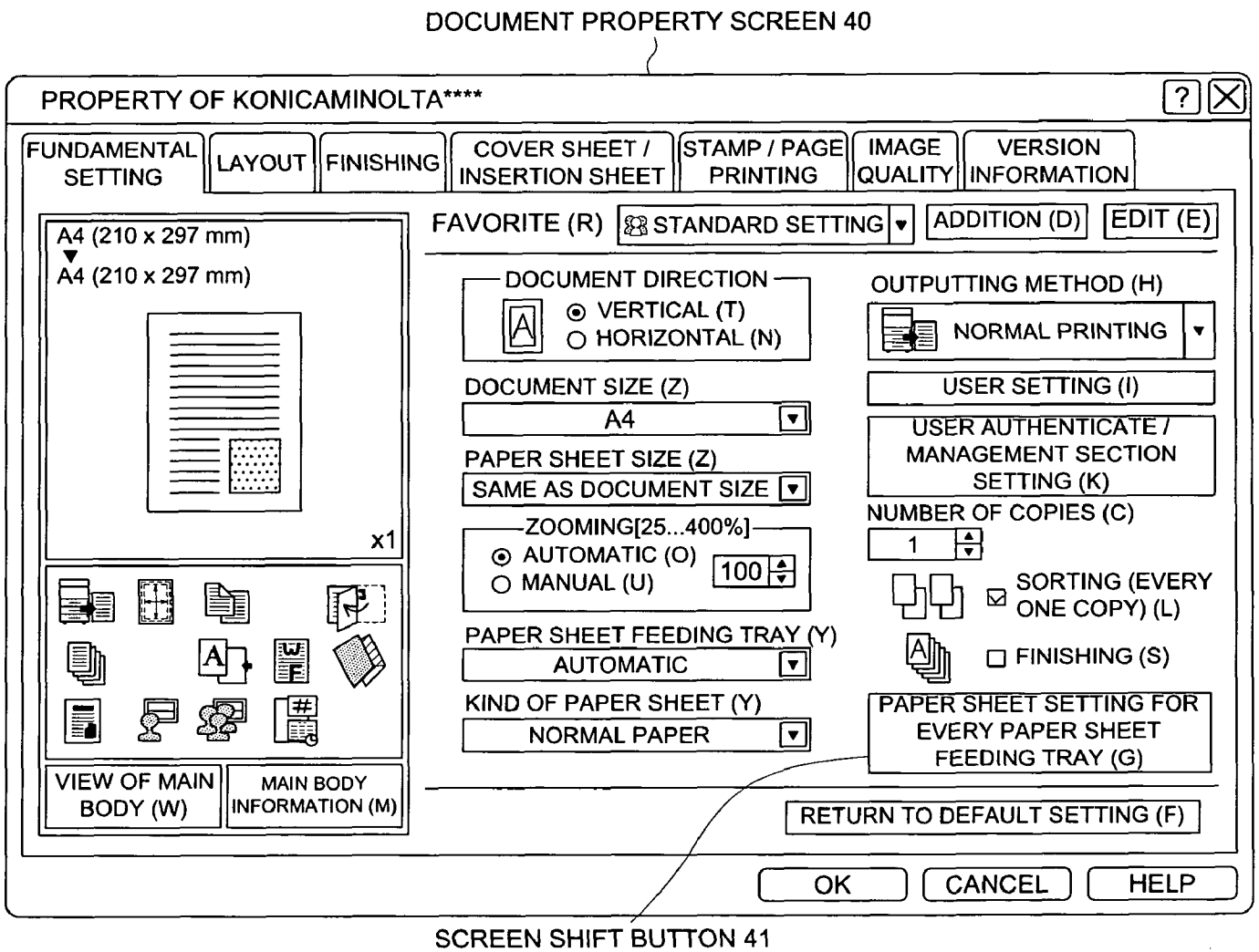
FIG. 6 shows an exemplary configuration of a screen (document property screen) to be displayed on a display section of the computer terminal device embodied in the present invention.
Figure 7:
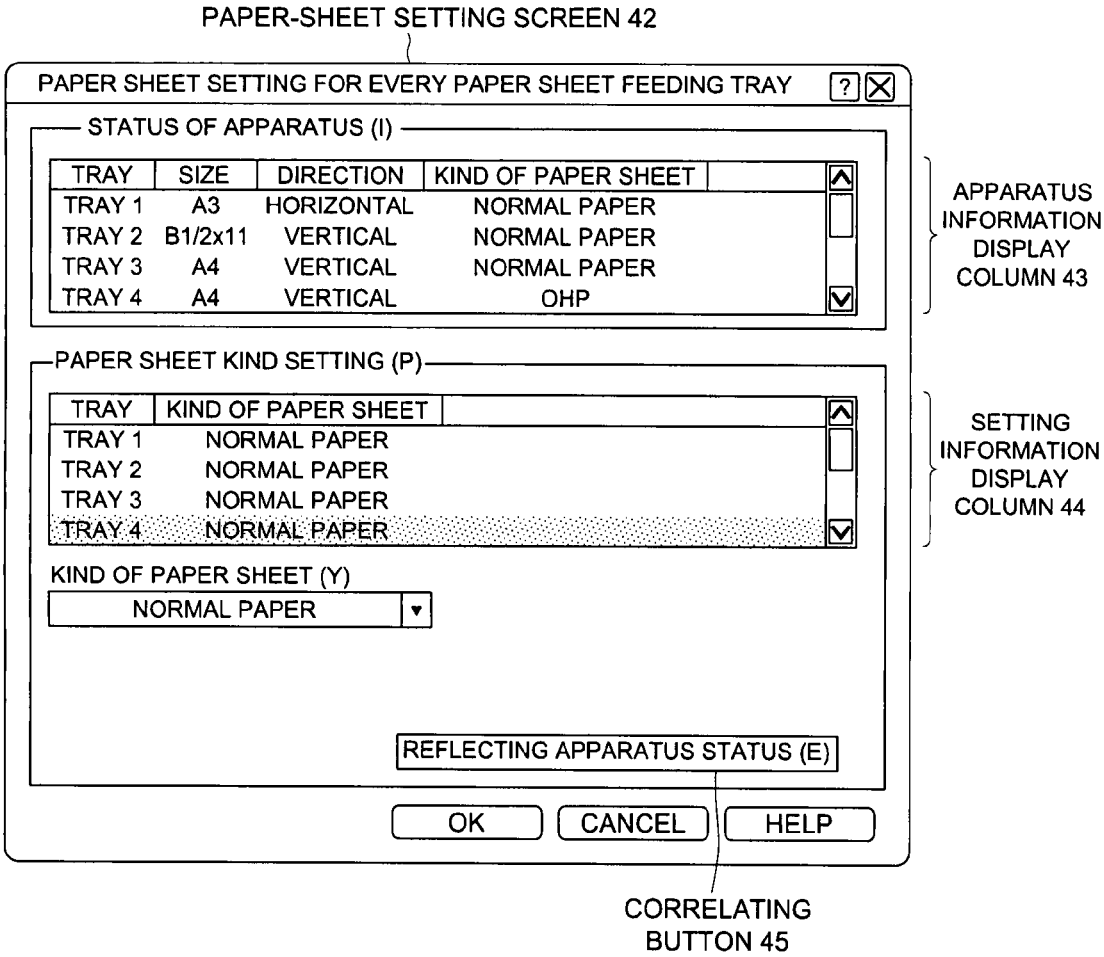
FIG. 7 shows an exemplary configuration of a screen (paper sheet setting screen) to be displayed on a display section of the computer terminal device embodied in the present invention.
Figure 8:
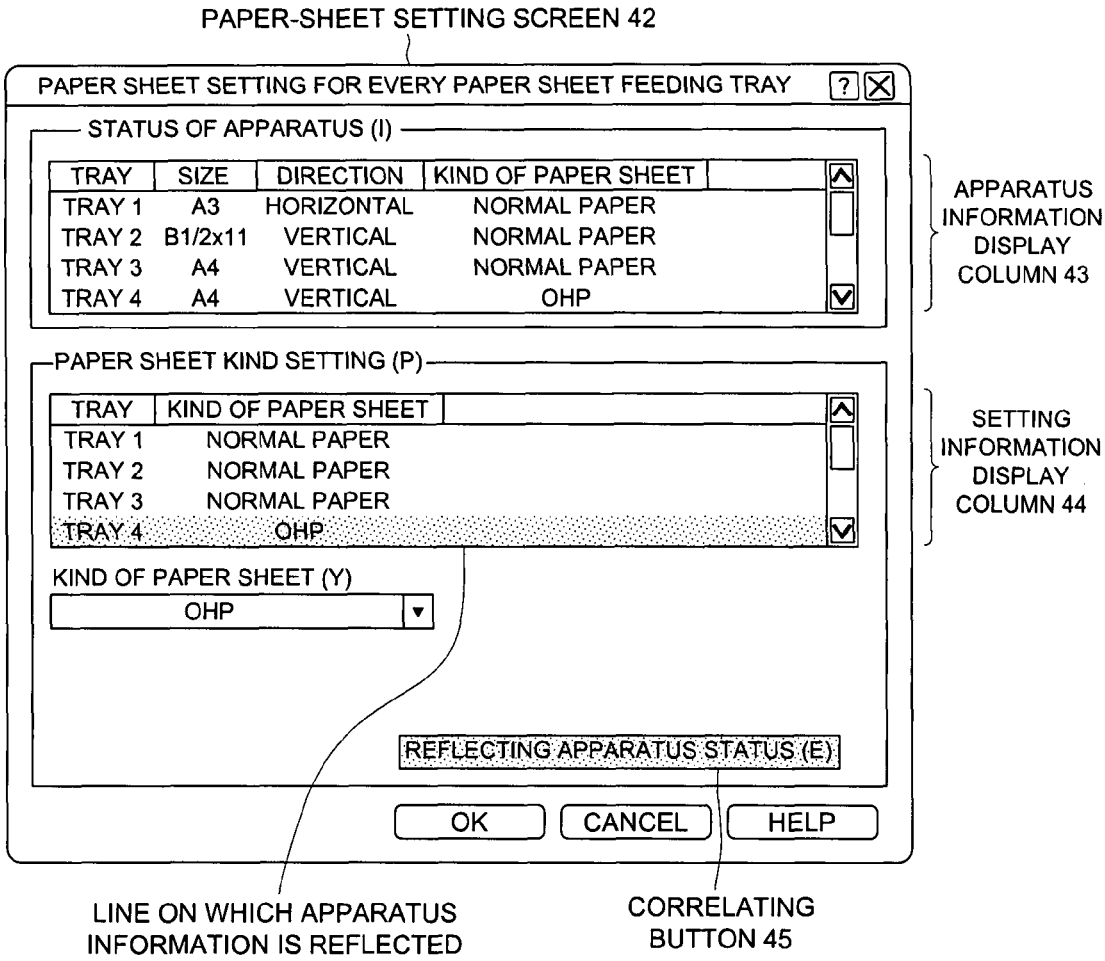
FIG. 8 shows an exemplary configuration of a screen (document property screen after a correlating operation) to be displayed on a display section of the computer terminal device embodied in the present invention.
Figure 9:
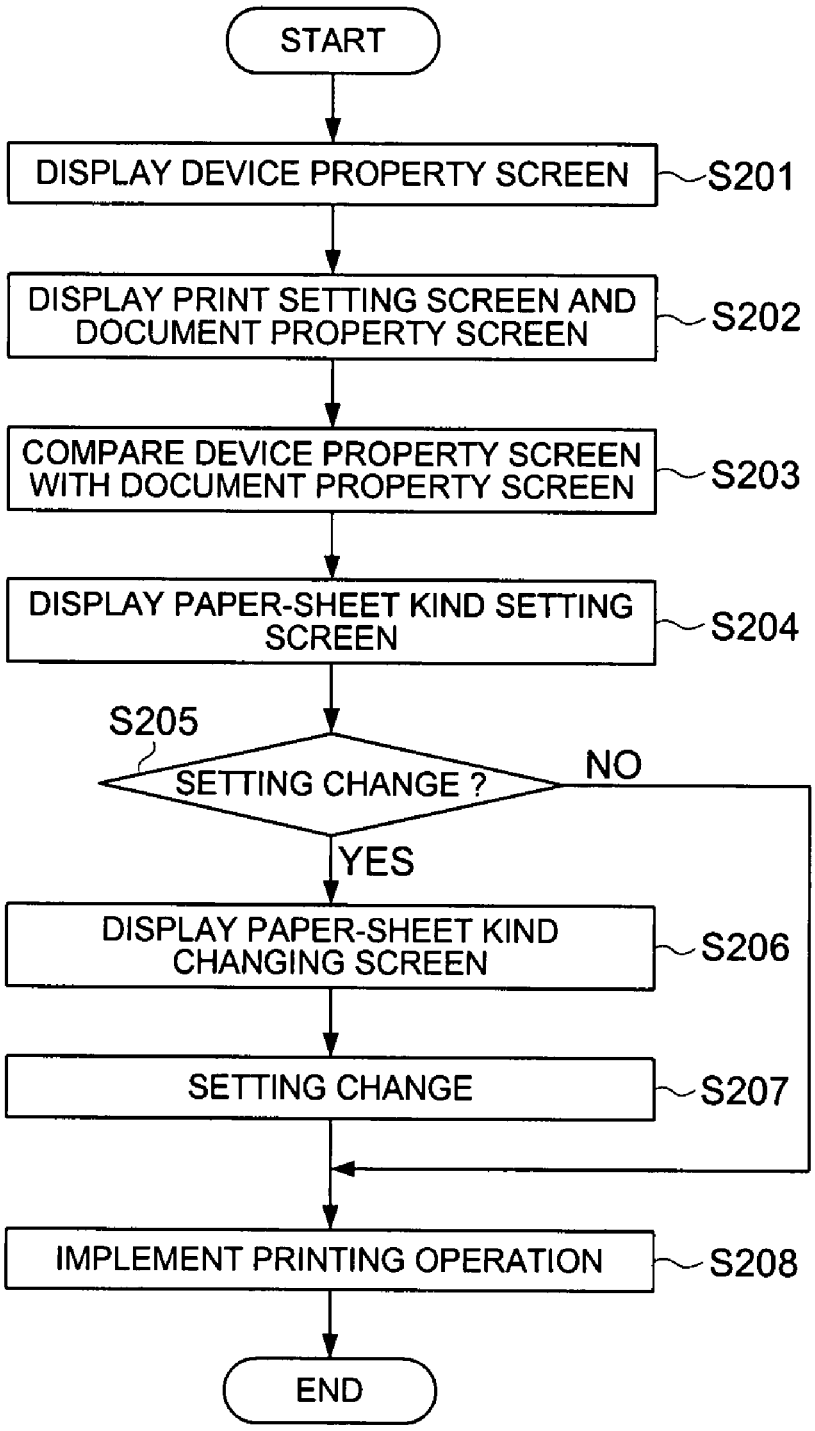
FIG. 9 PRIOR ART
FIG. 9 shows a flowchart indicating procedures of a conventional printing method.
Figure 10:
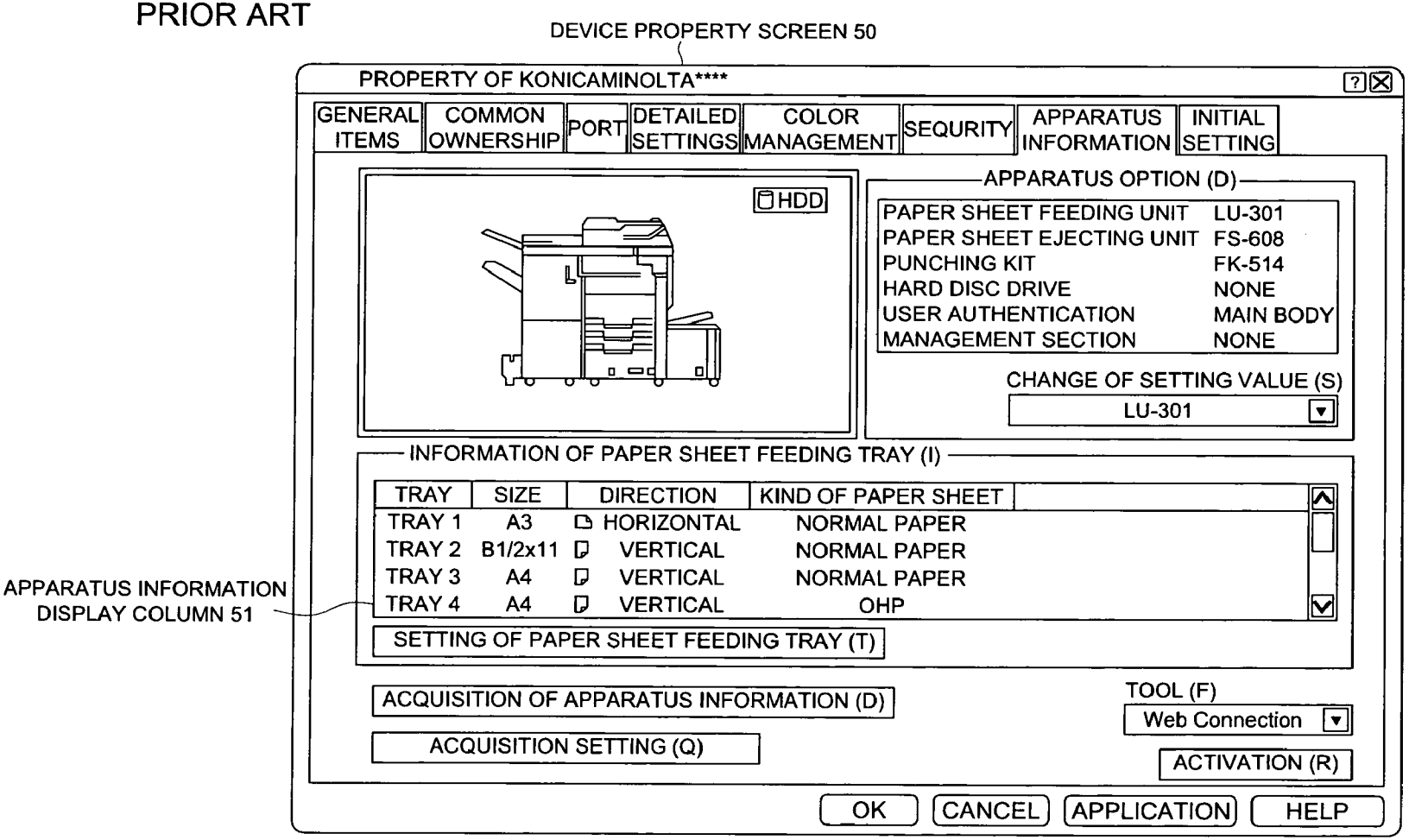
FIG. 10 PRIOR ART
FIG. 10 shows an exemplary configuration of a screen (document property screen) to be displayed on a display section of the conventional computer terminal device.
Figure 11:
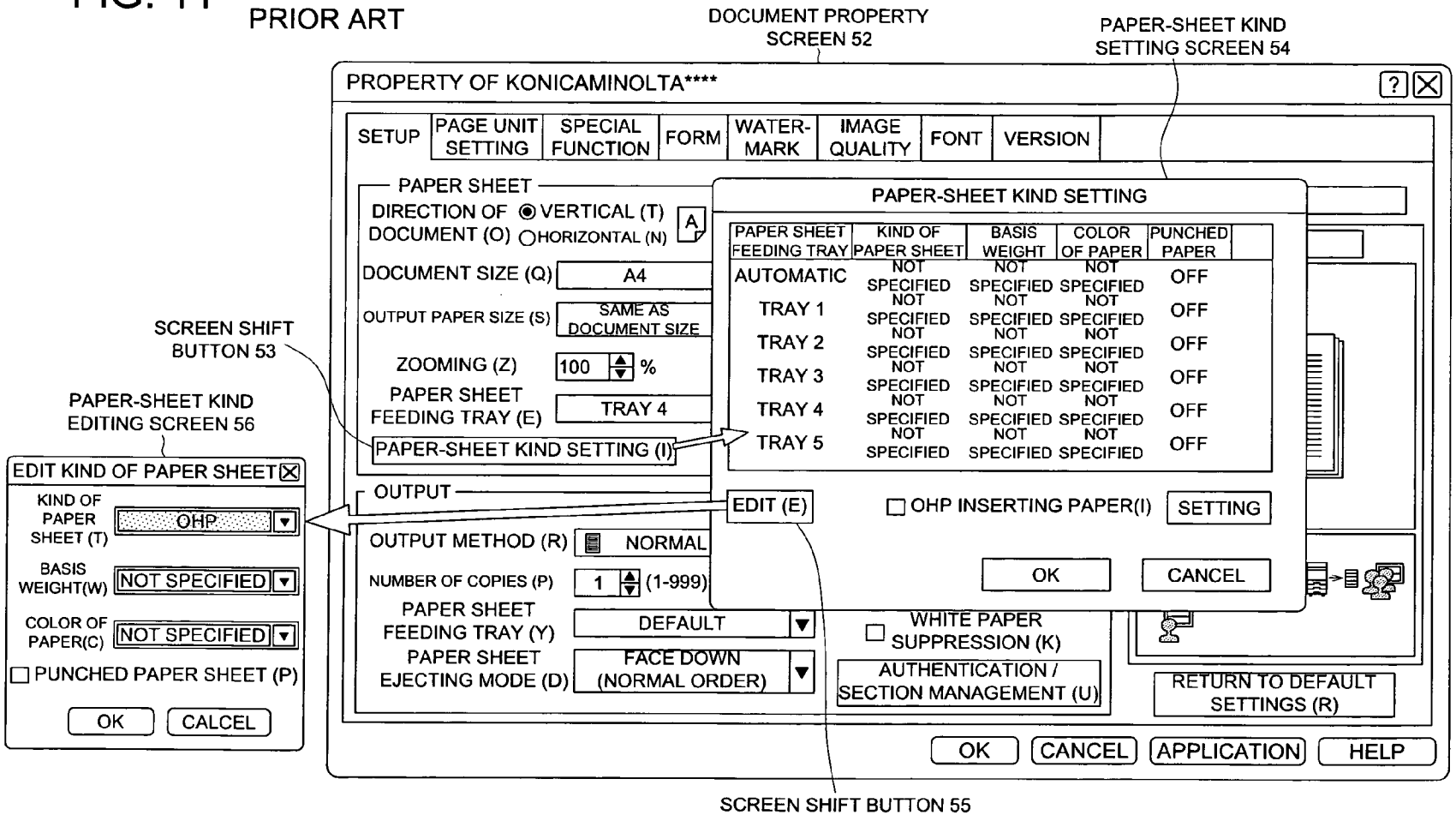
FIG. 11 PRIOR ART
FIG. 11 shows exemplary configurations of screens (document property screen, paper-sheet kind setting screen, paper-sheet kind editing screen) to be displayed on a display section of the conventional computer terminal device.

In order to describe the preferred and exemplary embodiment of the present invention in detail, referring to FIG. 1 through FIG. 8, a printing system, a printing method and a printer driver, embodied in the present invention, will be detailed in the following. FIG. 1 shows a schematic diagram of a configuration of the printing system embodied in the present invention, FIG. 2 shows a block diagram indicating a configuration of a computer terminal device, FIG. 3 shows a block diagram indicating functions of the printer driver, and FIG. 4 shows a block diagram indicating a configuration of the image forming apparatus. Further, FIG. 5 shows a flowchart of the printing procedures to be employed in the printing system embodied in the present invention. Still further, FIGS. 6-8 show exemplary configurations of screens to be displayed on the display section of the computer terminal device.

As shown in FIG. 1, a printing system 10, embodied in the present invention, is constituted by: a single or a plurality of computer terminal devices 20, each of which instruct the printing operation based on data (hereinafter, referred to as document data) created by an application program for creating the document (hereinafter, referred to as a document application program) or other data described in the Page Description Language converted from the document data (hereinafter, referred to as a print data); and a single or a plurality of image forming apparatuses 30, such as a printer, a digital multi-function peripheral, etc., which prints the document based on the print data acquired. The single or the plurality of computer terminal devices 20 and the single or the plurality of image forming apparatuses 30 are coupled to each other through a communication network, such as a LAN (Local Area Network), a WAN (Wide Area Network), etc.

Further, as shown in FIG. 2, the computer terminal device 20 is provided with a control section 21 including a CPU (Central Processing Unit) 21*a*, a ROM (Read Only Memory) 21*b*, a RAM (Random Access Memory) 21*c*, etc.; a storage section 22, such as a Hard Disc Drive, etc., to store various kinds of programs and data; an operation section 23, such as a keyboard, etc., to conduct various kinds of operations; a display section 24, such as an LCD (Liquid Crystal Display), etc., to display various kinds of screens detailed later; and a network coupling section 25, such as a NIC (Network Interface Card), a modem, etc., to couple the computer terminal device 20 to the communication network. In the normal operation, the OS (Operating System), the document application program and the device driver (hereinafter, referred to as the printer driver) are read form the ROM 21*b* or the storage section 22 into the RAM 21*c*, and are executed on the CPU 21*a*.

Further, by executing the print driver mentioned in the above, the control section 21 of the computer terminal device 20 serves as a print data creating section 26, an apparatus information acquiring section 27, a print condition setting section 28, a print instructing section 29, etc., as indicated in FIG. 3. Concretely speaking, the print data creating section 26 converts the document data to print data described in the Page Description Language so as to create the print data. Further, the apparatus information acquiring section 27 acquires information indicating an actual status of the paper sheets in the image forming apparatus 30 concerned (such as, a paper sheet feeding tray, a kind of paper sheets accommodated in the paper sheet feeding tray concerned, etc.; hereinafter, referred to as apparatus information). Still further, the print condition setting section 28 makes the display section 24 display a screen (hereinafter, referred to as a document property screen) from which the user sets conditions for making the image forming apparatus 30 implement the printing operation (such as a document direction, a document size, a paper sheet size, a paper sheet feeding tray, a kind of paper sheet, an outputting method, a number of copies, a post processing method, etc.; hereinafter, referred to as print conditions), and in addition to the above, makes the display section 24 display both the apparatus information and information established in advance by the user or as default information (hereinafter, referred to as setting information) within a screen for setting the items in regard to the paper sheets (serving as a paper sheet setting screen, detailed later), so as to make it possible for the user to correlate the apparatus information and the setting information with each other by operation a specific button (serving as a correlation button, detailed later) equipped in the paper sheet setting screen concerned.

In this connection, although a personal computer is indicated as the computer terminal device 20 in FIG. 1, any other device, such as, for instance, a PDA (Personal Digital Assistants) device, a Cellular Phone, etc., can be employed as the computer terminal device 20, as far as the concerned device is capable of instructing the printing operation based on the document data. Further, although the document application program and the printer driver are stored in the storage section 22 in the configuration shown in FIG. 1, it is also applicable that those programs are stored in another computer terminal device or a server coupled to the computer terminal device 20 through the communication network, so that the computer terminal device 20 can read out each of them from the other computer terminal device or the server when executing the program concerned, or the other computer terminal device or the server executes the program concerned.

Further, in the configuration shown in FIG. 3, the control section 21 of the computer terminal device 20 serves as the print data creating section 26, the apparatus information acquiring section 27, the print condition setting section 28 and the print instructing section 29, by executing the printer driver. However, since the document data is processable in the image forming apparatus 30 when the document data is any one of data created on the basis of the XPS (XML Paper Specification), PDF (Portable Document Format) data, data described by the PS (Post Script), the PCL (Printer Control Language), etc., it is possible to omit the print data creating section 26 in any one of the abovementioned cases, or it is also possible to omit the print instructing section 29, if the document application program and/or the OS has a function as the print instructing section 29.

Still further, as shown in FIG. 4, the image forming apparatus 30 is constituted by a CPU 31*a*, a ROM 31*b*, a RAM 31*c*, a HDD (Hard Disc Drive) 32, a USB (Universal Serial Bus) interface 33, a LAN interface 34, a display operating section 35, a language analyzing section 36, an image processing section 37, a printing section 38, etc., all of which are coupled to each other through a bus.

The ROM 31*b* stores various kinds of programs and data necessary for controlling the overall operations of the image forming apparatus 30 in it. The RAM 31*c* temporarily stores data to be employed for a controlling operation currently conducted by the CPU 31*a* and/or other data to be temporarily stored during the controlling operation in it. Accordingly, in conjunction with the ROM 31*b* and the RAM 31*c*, the CPU 31*a* serves as a controlling section 31 to control the overall operations of the image forming apparatus 30.

The HDD 32 stores various kinds of the print data, etc., acquired from the computer terminal device 20 in it.

The LAN interface 34 serves as an interface for coupling the image forming apparatus 30 to the communication network, such as a NIC, a modem, etc., so as to receive the print data and the setting information transmitted from the computer terminal device 20.

The USB interface 33 serves as another interface for coupling various kinds of USB (Universal Serial Bus) devices, such as a USB memory, etc., to the image forming apparatus 30.

The display operating section 35 is constituted by a displaying section, such as a LCD (Liquid Crystal Display), etc., and an operating section, such as a touch panel, etc., so as to display icons, key-buttons and various kinds of settings necessary for the printing operation on the LCD or the like, and to output operational signals inputted from the touch panel or the like.

The language analyzing section 36 parses the print data acquired from the computer terminal device 20 through the LAN interface 34, so as to create new data described in an intermediate format (hereinafter, referred to as intermediate data) to be developed into other data described in a bitmap format (hereinafter, referred to as bitmap data) from the acquired print data.

The image processing section 37 creates the bitmap data, serving as printable data, from the intermediate data created by the language analyzing section 36.

The printing section 38 prints an image based on the bitmap data created by the image processing section 37. Concretely speaking, in the printing section 38, an exposure section irradiates a light (for instance, a laser beam) modulated according to the bitmap data onto a photoreceptor drum uniformly charged with electrostatic charge by a charging device, so as to form a latent image on the photoreceptor drum. Successively, a developing device develops the latent image with toner, and the developed toner image is finally transferred onto a paper medium through a primary transfer roller and a secondary transfer belt. Then, a fixing device fixes the toner image onto the paper medium.

In this connection, it is applicable that each of the language analyzing section 36 and the image processing section 37 can be configured as either a hardware structure or a computer program to be executed on the control section 31 so as to makes the computer serve as the language analyzing section 36 or the image processing section 37. Further, since the configuration shown in FIG. 4 is merely one of examples of the image forming apparatuses embodied in the present invention, it is also applicable that the USB interface 33, etc. can be excluded from the configuration, and/or a finisher that conducts various kinds of post processing, such as a staple processing, a punch processing, etc., is added to the configuration.

In this connection, as described in the "BACKGROUND OF THE INVENTION", in the conventional printing system, it is possible for the user to set the setting items in regard to the paper sheet, such as a paper sheet feeding tray, a kind of paper sheet, etc., by using the document property screen, the paper-sheet kind setting screen, the paper-sheet kind editing screen, etc. However, since the setting contents set by using the abovementioned screens do not necessary agree with the actual status of the image forming apparatus, sometimes, the user erroneously sets the paper sheet feeding tray, the kind of paper sheet, etc. To avoid such the erroneous settings, in the typical situation, the user should confirm the actual status of the image forming apparatus from the device property screen, resulting in the problem that the user's maneuverability becomes bad.

To overcome the abovementioned problem, in the present embodiment, the apparatus information, indicating the actual status in respect to the paper sheets accommodated in the image forming apparatus 30, and the setting information, established in advance by the user or as the default information in respect to the paper sheets, are simultaneously indicated on a predetermined screen displayed on the display section 24 under the controlling operations conducted by the control section 21 of the computer terminal device 20. At the same time, a button for reflecting the apparatus information onto the setting information is displayed on the same screen, so as to make it possible for the user not only to appropriately set the items, such as a paper sheet feeding tray, a kind of paper sheet, etc., without confirming the actual status of the image forming apparatus by using the device property screen, but also to automatically set the appropriate paper sheet feeding tray and the appropriate kind of paper sheet, without conducting the setting change operation by shifting the screen.

Concretely speaking, in a document property screen 40 shown in FIG. 6, when the user depresses a screen shift button 41 (herein, the "PAPER-SHEET SETTING FOR EACH PAPER SHEET FEEDING TRAY" button), a paper-sheet setting screen 42 shown in FIG. 7 is displayed. Further, an apparatus information display column 43 for displaying apparatus information, a setting information display column 44 for displaying setting information and a correlating button 45 (herein, the "APPARATUS STATUS REFLECTION" button) for reflecting the contents of apparatus information display column 43 onto the setting information display column 44 are provided in the paper-sheet setting screen 42.

In this connection, the screen configuration shown in FIG. 7 is merely an example among various screen configurations. Accordingly, a structure, a layout, a size, a design, etc. of each column and each button can be freely designed, as far as the apparatus information display column 43 and the setting information display column 44 are displayed in such a manner that both of them are comparable relative to each other, and it is possible for the user to instruct the correlating operation between the apparatus information display column 43 and the setting information display column 44.

Next, referring to the flowchart shown in FIG. 5, the concrete processing to be conducted by the computer terminal device 20 will be detailed in the following.

At first, the user conducts predetermined operations to read out the document application program from the ROM 21*b*, the storage section 22, or the other computer terminal device or the server coupled through the communication network, etc., in order to activate the document application program on the own computer terminal device, or to activate it on the other computer terminal device or the server. Then, the user creates the document data, serving as a printing object, by using the document application program concerned. In this connection, the scope of the document data is not limited to one created in this step, but it is also applicable that the document data created in advance are acquired from the ROM 21*b*, the storage section 22, or the other computer terminal device or the server.

Successively, when the user conducts predetermined operations on the screen of the document application program, the control section 21 controls the display section 24 to display the print setting screen for conducting operations for selecting the image forming apparatus 30, which implements the printing operation, and for setting pages to be printed, a number of copies, etc. (Step S101).

Still successively, when the user depresses the predetermined button (in a typical case, the property button) provided in the print setting screen, the control section 21 serves as the print condition setting section 28 while referring to the printer driver by the printing function of the OS. Then, the print condition setting section 28 of the control section 21 (or the printer driver) controls the display section 24 so as to display the document property screen 40 shown in FIG. 6 (Step S102). In this connection, although the printer driver is executed on the computer terminal device 20 in the present embodiment, when the printer driver installed in the other computer terminal device or the server coupled to the computer terminal device 20 through the communication network can be commonly owned by the computer terminal device 20, it is also applicable that the printer driver is executed on the other computer terminal device or the server.

Still successively, the user confirms the document size and the paper sheet feeding tray displayed on the document property screen 40, and determines whether or not the setting change should be conducted (Step S103). When determining that the setting change should be conducted (Step S103; Yes), the user depresses the screen shift button 41 (herein, the "PAPER-SHEET SETTING FOR EACH PAPER SHEET FEEDING TRAY" button). Then, the apparatus information acquiring section 27 of the control section 21 (or the printer driver) communicates with the image forming apparatus 30 through the communication network by employing the network coupling section 25, so as to acquire the apparatus information from the image forming apparatus 30 (Step S104). Still successively, the print condition setting section 28 of the control section 21 (or the printer driver) makes the display section 24 display the paper-sheet setting screen 42 as shown in FIG. 7 (Step S105).

In this connection, in the conventional system, since the apparatus information and the setting information are displayed on the separate screens, there have been the problems that errors in the setting items in regard to the paper sheet are liable to occur, and the user's maneuverability during the printing operation is bad. However, in the present embodiment, since both the apparatus information display column 43 and the setting information display column 44 are displayed within the paper-sheet setting screen 42, it becomes possible for the user to easily confirm whether or not the setting information (namely, the paper sheet feeding tray and the kind of paper sheet), indicated in the setting information display column 44, are appropriate, while referring to the apparatus information indicated in the apparatus information display column 43. Further, when the user determines that the setting information is inappropriate (namely, the apparatus information does not coincide with the setting information), the user can correct the setting information.

Even for the abovementioned operation, in the conventional system, the user should shift the screen to the paper-sheet kind setting screen 54 and/or the paper-sheet kind editing screen 56 by operating the predetermined buttons in order to conduct the setting change operation. Accordingly, there have been the problems that errors in the setting items in regard to the paper sheet are liable to occur, and the user's maneuverability during the printing operation is bad. However, in the present embodiment, since the correlating button 45 is provided in the paper-sheet setting screen 42, it becomes possible for the user to easily correct the setting information by operating the correlating button 45.

Yet successively, detecting the depression of the correlating button 45 (Step S106), the print condition setting section 28 of the control section 21 (or the printer driver) compares the apparatus information indicated in the apparatus information display column 43 with the setting information indicated in the setting information display column 44. When the apparatus information and the setting information are different from each other, the print condition setting section 28 corrects the setting information based on the apparatus information, and correlates the apparatus information and the setting information with each other so as to display the paper-sheet setting screen 42 shown in FIG. 8 on the display section 24 (Step S107). Concretely speaking, since the OHP sheets are actually accommodated in the tray 4 as indicated in the apparatus information display column 43, the kind of paper sheet of the tray 4 indicated in the setting information display column 44 is also changed to the "OHP". In this connection, although the configuration in which the apparatus information and the setting information are correlated with each other is exemplified in the present embodiment, the other configuration in which the user selects a desired kind of paper sheet in the column of the kind of paper sheet of the paper-sheet setting screen, shown in FIG. 7, is also applicable.

After that, when the user depresses the OK button provided in the paper-sheet setting screen 42 so as to return to the document property screen 40, and further depresses the OK button provided in the document property screen 40 so as to return to the print setting screen, and still further depresses the predetermined button (printing button) provided in the print setting screen, the print data creating section 26 of the control section 21 (or the printer driver) converts the document data to print data described in the Page Description Language so as to create the print data (Step S108). Then, the print instructing section 29 of the control section 21 (or the printer driver) transmits the print data and the printing conditions indicated in the document property screen 40 to the image forming apparatus 30, in order to make the image forming apparatus 30 implement the printing operation (Step S109).

As described in the foregoing, in the present embodiment, both the apparatus information, indicating the actual status in regard to the paper sheets in the image forming apparatus 30, and the setting information, established in advance by the user or as the default information in respect to the paper sheets, are displayed on the paper-sheet setting screen 42, and further, the correlating button 45 is provided in the paper-sheet setting screen 42 so that the contents of the apparatus information can be reflected onto the setting information (in other words, the setting information is corrected on the basis of the apparatus information, and then, the apparatus information and the setting information are correlated with each other). According to the abovementioned features, it becomes possible not only to prevent errors in the setting items in regard to the paper sheet, such as a paper sheet feeding tray, a kind of paper sheet, etc., in advance, but also to remarkably improve the user's maneuverability during the printing operation.

In this connection, although the paper sheet feeding tray and the kind of paper sheet are exemplified as the information to be compared in the explanations of the embodiment described in the foregoing, the scope of the present invention is not limited to the above. The present invention is also applicable for any other items to be arbitrarily established by the user (for instance, a size of the paper sheet, a direction of the paper sheet, etc.), as well.

The present invention is usable for an arbitral printing system, in which a single or a plurality of computer terminal device(s) to instruct a printing operation and a single or a plurality of image forming apparatus(es) to implement the printing operation are coupled to each other through a communication network, a printing method to be employed in the printing system concerned and a printer driver to control the image forming apparatus.

According to the printing system, the printing method and the printer driver embodied in the present invention, it becomes possible not only to prevent errors in the setting items in regard to the paper sheet, such as a paper sheet feeding tray, a kind of paper sheet, etc., in advance, but also to improve the user's maneuverability during the printing operation.

This is because, when the user sets the items in regard to the paper sheet, such as a kind of paper-sheet feeding tray, a kind of paper sheet, etc., since the apparatus information acquiring section (or the printer driver) of the controlling section of the computer terminal device acquires the apparatus information, indicating an actual status in regard to the paper sheet accommodated in the image forming apparatus, from the image forming apparatus, and the print condition setting section displays both the abovementioned apparatus information and the setting information, established in advance by a user or established in advance as default information, onto the paper sheet setting screen for setting print conditions, it becomes possible for the user to easily confirm whether or not the setting items in regard to the paper sheet is correct only on the paper sheet setting screen, without displaying the device property screen indicating the actual status of the image forming apparatus.

Further, since the apparatus information acquiring section (or the printer driver) of the controlling section of the computer terminal device displays the correlating button for correlating the apparatus information and the setting information with each other, so as to conduct the controlling operation for reflecting the contents of the apparatus information onto the setting information when the correlating button is depressed, it becomes possible for the user to correct the setting information by merely operating the abovementioned correlating button, without sifting the screen to the paper-sheet kind setting screen and the paper-sheet kind editing screen to change the contend of the settings.

While the preferred embodiments of the present invention have been described using specific term, such description is for illustrative purpose only, and it is to be understood that changes and variations may be made without departing from the spirit and scope of the appended claims.

What is claimed is:

1. A printing system, comprising:

a computer terminal device to issue an instruction for implementing a printing operation; and an image forming apparatus that receives the instruction issued by the computer terminal device to implement the printing operation;

wherein the computer terminal device and the image forming apparatus are coupled to each other through a communication network; and wherein the computer terminal device includes:

an apparatus information acquiring section to acquire apparatus information that includes information in regard to a kind of paper-sheet feeding tray provided in the image forming apparatus and a kind of paper sheet corresponding to the paper-sheet feeding tray, from the image forming apparatus;

a display section to display a specific screen for setting a print condition; and a print condition setting section to control the display section, so that both the apparatus information and setting information that includes information in regard to a kind of paper-sheet feeding tray and a kind of paper sheet corresponding to the paper-sheet feeding tray, which are established in advance by a user or established in advance as default information, are displayed on the specific screen.

2. The printing system of claim 1, wherein the print condition setting section controls the display section to display a specific button on the specific screen; and wherein, when the specific button is designated, the print condition setting section corrects the setting information based on the apparatus information, so as to correlate the apparatus information and the setting information with each other.

3. A printing method employed in a system, in which a computer terminal device to issue an instruction for implementing a printing operation, and an image forming apparatus that receives the instruction issued by the computer terminal device, to implement the printing operation, are coupled to each other through a communication network, the printing method comprising:

acquiring apparatus information that includes information in regard to a kind of paper-sheet feeding tray provided in the image forming apparatus and a kind of paper sheet corresponding to the paper-sheet feeding tray, from the image forming apparatus through the communication network by the computer terminal device; and displaying a specific screen for setting a print condition on a display section provided in the computer terminal device;

wherein, in the displaying step, both the apparatus information and setting information that includes information in regard to a kind of paper-sheet feeding tray and a kind of paper sheet corresponding to the paper-sheet feeding tray, which are established in advance by a user or established in advance as default information, are displayed on the specific screen.

4. The printing method of claim 3, wherein, in the displaying step, a specific button is displayed on the specific screen; and wherein, when the specific button is designated, the setting information is corrected, based on the apparatus information, so as to correlate the apparatus information and the setting information with each other.

5. A computer readable medium storing a computer executable program for controlling an image forming apparatus to be coupled to a computer through a communication network, the program comprising program code for causing the computer to perform the steps of:

acquiring apparatus information that includes information in regard to a kind of paper-sheet feeding tray provided in the image forming apparatus and a kind of paper sheet corresponding to the paper-sheet feeding tray, from the image forming apparatus through the communication network;

displaying a specific screen for setting a print condition on a display section provided in the computer; and controlling the display section, so that both the apparatus information and setting information that includes information in regard to a kind of paper-sheet feeding tray and a kind of paper sheet corresponding to the paper-sheet feeding tray, which are established in advance by a user or established in advance as default information, are displayed on the specific screen.

6. The computer readable medium of claim 5, wherein, in the displaying step, a specific button is displayed on the specific screen; and wherein, when the specific button is designated, the setting information is corrected, based on the apparatus information, so as to correlate the apparatus information and the setting information with each other.

* * * * *